United States Patent [19]

Böder et al.

[11] Patent Number: 4,736,909

[45] Date of Patent: Apr. 12, 1988

[54] GUIDE ASSEMBLY HAVING UNFOLDABLE FINS FOR PROJECTILES AND MISSILES

[75] Inventors: Dieter Böder; Michael Primus, both of Düsseldorf, Fed. Rep. of Germany

[73] Assignee: Rheinmetall GmbH, Düsseldorf, Fed. Rep. of Germany

[21] Appl. No.: 58,936

[22] Filed: Jun. 5, 1987

[30] Foreign Application Priority Data

Jun. 5, 1986 [DE] Fed. Rep. of Germany ..... 3618956

[51] Int. Cl.[4] ..... F42B 13/32

[52] U.S. Cl. ..... 244/3.29

[58] Field of Search ..... 244/3.23, 3.29; 244/3.28

[56] References Cited

U.S. PATENT DOCUMENTS 2,923,241 2/1960 House ..... 244/3.29

3,103,886 9/1963 Popenoe ..... 244/3.29

3,360,216 12/1967 Schwesig ..... 244/3.29

FOREIGN PATENT DOCUMENTS

WO86/02154 4/1986 PCT Int'l Appl. ..... 244/3.29

745252 2/1956 United Kingdom ..... 244/3.29

*Primary Examiner*—Charles T. Jordan

*Assistant Examiner*—Michael J. Carone

*Attorney, Agent, or Firm*—Spencer & Frank

[57] ABSTRACT

A guide assembly for a missile or projectile which has a plurality of space saving, foldable fins, with each such fin being composed of two fin blades that are connected together at their tips and whose root ends are fastened in different bearings. To prevent bending or bulging of the fin blades in the unfolded state of the fins, at least one bending prevention arrangement is disposed between the fin blades in the vicinity of their root ends.

6 Claims, 4 Drawing Sheets

GUIDE ASSEMBLY HAVING UNFOLDABLE FINS FOR PROJECTILES AND MISSILES

BACKGROUND OF THE INVENTION

The present invention relates to a guide assembly of the type including unfoldable fins for projectiles and missiles. More particularly, the present invention relates to a guide assembly, including a plurality of unfoldable fins, for projectiles and missiles, wherein each fin comprises two fin blades which are connected together at their tips and whose roots are fastened to separate bearings whose circumferential spacing is variable such that the fin blades are arranged in the manner of a peaked roof in the unfolded state of the fins, and the bearings are composed of an articulated fixed bearing and an articulated slide guide bearing.

Guide assemblies of the above type are disclosed, for example, in International patent Publication No. WO 86/02154 (International Serial Number PCT/EPO/85/00452). These prior art guide assemblies have the drawback that under high air pressure forces, the foldable fins may be bent or bulge out near their roots. The fin blade facing away from the attacking air is particularly endangered in this case.

SUMMARY OF THE INVENTION

It is therefore an object of the invention to further develop a guide assembly of the above-mentioned type so that bending or bulging of the fin blades is avoided in a simple manner.

The above object is achieved according to the present invention in that in a guide assembly for projectiles and missiles of the type which has a plurality of fins which are foldable and unfoldable in the circumferential direction, with each fin including two fin blades which are connected together at their tips and which have their roots fastened to separate bearings, one of which is of an articulated fixed bearing and the other of which is an articulated slide guide bearing, which are mounted on the guide assembly and whose circumferential spacing is variable such that the fin blades, in the unfolded state of the fins, are arranged in the manner of a peaked roof when viewed in the direction of the longitudinal axis of the guide assembly; at least one means are provided between the two fin blades of a fin in the vicinity of their roots for preventing bending of the fin blades under stress when the fin is in the unfolded state.

According to the preferred embodiment of the invention, the fin blades are of the type which would tend to bend outwardly without the bending prevention means, and the bending prevention means comprise pulling means for exerting a pulling force between the two fin blades of the fin when the unfolded fin is stressed. Each pulling means is, for example, a wire, a strip of sheet metal or a chain connected between the fin blades of a fin.

The invention will be described in greater detail below with reference to various embodiments and to the drawing figures.

DETAILED DESCRIPTION OF THE PREFERRED EMBODIMENTS

Figure 1:
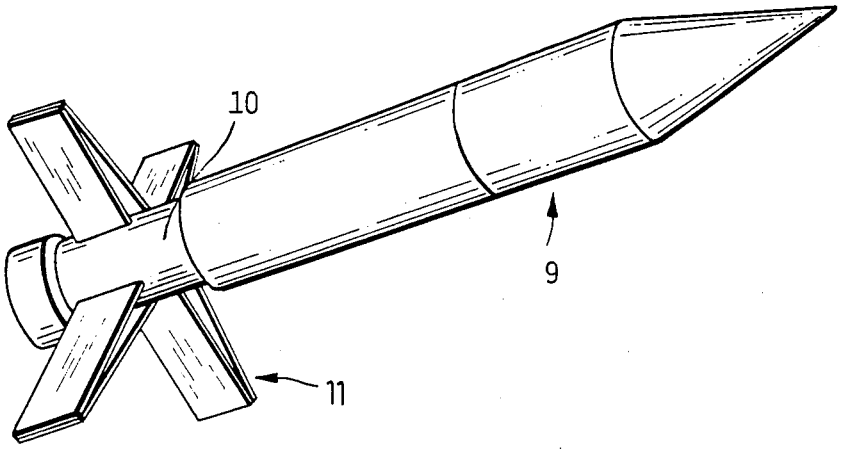
FIG. 1 is a perspective, highly schematic view of a missile of the type to which the present invention pertains, i.e., a missile having a guide assembly including unfoldable fins.

FIG. 1 is a schematic, perspective view of a missile 9 having a guide assembly 10 disposed in its tail section and including a plurality of unfoldable fins 11.

Missiles of this type and also projectiles are packed, in particular, as secondary ammunition elements in carrier projectile bodies, and are launched by launchers or fired from large caliber tubular weapons so as to reach target points at a large distance with the greatest possible precision.

Figure 2:
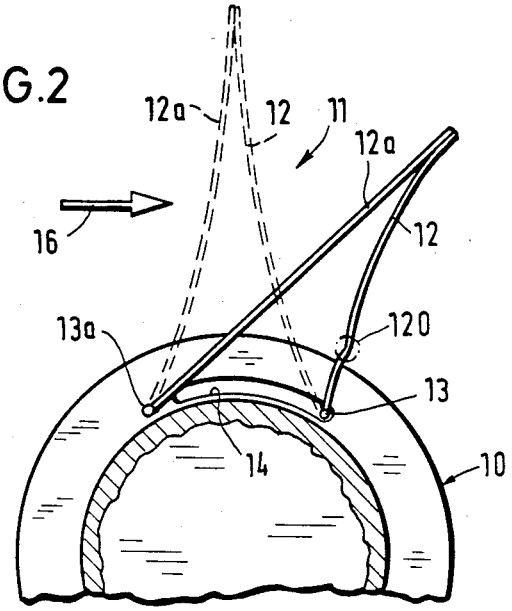
FIGS. 2 and 3 are cross-sectional views of a part of a guide assembly for a missile as shown in FIG. 1 with a fin according to the prior art, and in which the fin blade facing away from the air pressure forces is beginning to bend over.

FIG. 2 is a cross-sectional view of part of missile 9 of FIG. 1 seen toward the side edges of a fin 11 of the guide assembly, for example after ejection in the target area from the carrier projectile body, with the fin 11 unfolded. Fin 11 is composed of two fin blades 12, 12*a* whose tips are connected together, for example by riveting or electron beam welding, and whose lower ends or roots are fastened to separate bearings 13, 13*a* which are mounted on the guide assembly 10 and whose spacing along the circumference of the guide assembly is variable so that when fin 11 is in the normal unfolded state as shown in dashed lines FIG. 2, fin blades 12, 12*a* are disposed in the manner of a peaked roof i.e., an inverted V-shape. Fin blades 12, 12*a* themselves are made of an elastic and flexible material, such as, for example, spring steel, a high strength light metal alloy or a fiber reinforced plastic, which facilitates their collapsing and accommodation in the interior of missile 9. However, in the unfolded state shown in FIG. 2, the flexible blades 12, 12*a* form a very stable arrangement with excellent aerodynamic characteristics.

The variable spacing of the bearings 13, 13*a* is achieved in that one of the bearings, bearing 13*a* in the illustrated embodiment, is an articulated fixed bearing, while the other bearing 13 is for example an articulated slide guide bearing which is guided in a circumferentially extending groove 14 in a manner as generally described in the above mentioned International patent Publication. The bearing 13 is disposed at the right-hand end of the groove 14 when the fin 11 is in the folded state (see for example FIG. 5) and moves to the illustrated position when the folded fin 11 is released and moves to the unfolded state.

As indicated above, the position of the fin blades 12, and 12*a* under normal air pressure conditions is shown in dashed lines in FIG. 2. If the air pressure forces are very strong, as may occur briefly, for example, during firing of spin stabilized projectiles, fin blades 12, 12*a* may be bent or bulge out as shown in solid line in FIG. 2.

The fin blade facing away from the air pressure forces is particularly in danger of being bent or bulging. This is the blade marked 12 in FIG. 2. The air pressure forces are indicated by an arrow 16.

Figure 3:
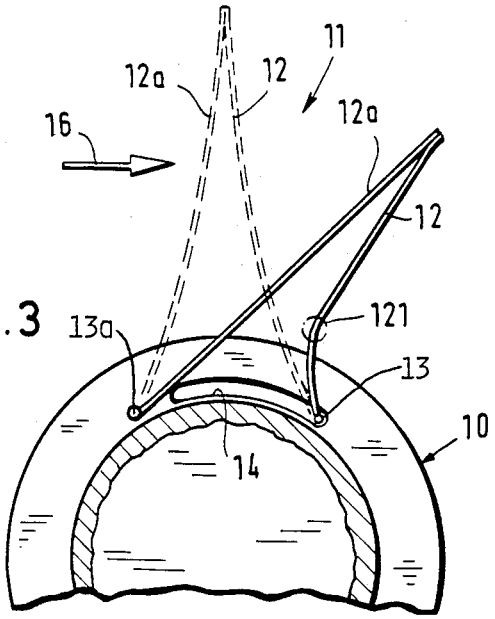

Depending on the structural configuration of the fin blades 12 and 12*a*, they are bent or bulge toward the outside or toward the inside. FIG. 2 shows an example in which the fin blade 12 begins to bend toward the outside at point 120, while FIG. 3 shows fin blade 12 as it begins to bend over toward the inside at point 121.

According to the invention, bending or bulging of the fin blades is prevented by providing a bending prevention arrangement between the fin blades 12 and 12*a* at or near their root ends, i.e. within the lower half of fin blades 12 and 12*a*.

Figure 4:
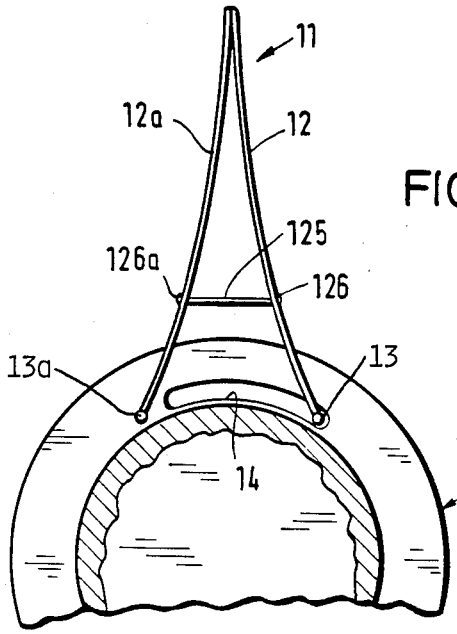
FIG. 4 is a cross-sectional view of a part of a guide assembly of a missile as shown in FIG. 1, with an unfoldable fin having a bending prevention arrangement according to the invention disposed between the fin blades.

One embodiment of such a bending prevention arrangement is shown in FIG. 4. It is essentially composed of at least one wire 125 which is fastened to each of the fin blades 12 and 12*a*, e.g. by placing the wire through bores provided in the fin blades 12 and 12*a* and soldering same in place. The solder locations are marked 126 and 126*a*. Instead of a wire, the flexible element 125 may be formed of, for example, a strip of sheet metal or a chain.

Figure 5:
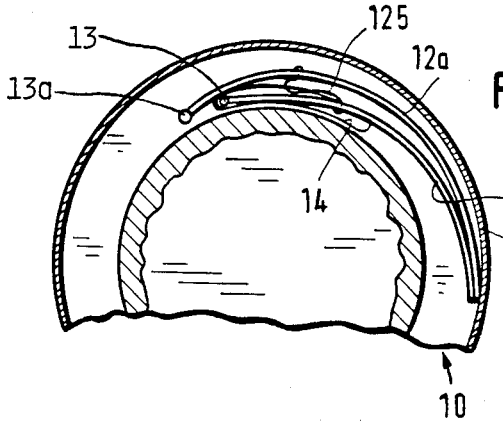
FIG. 5 is a cross-sectional view of a part of the guide assembly of the missile shown in FIG. 4 but with the fin collapsed and the bending prevention arrangement folded in between the fin blades.

In FIG. 5, the respective fin blades 12 and 12*a*, with the wire 125 connected between same, are shown in the collapsed or folded state. In this figure the numeral 15 identifies the jacket of the carrier projectile which maintains the fin 11 in the folded state.

A prerequisite for the effectiveness of the bending prevention arrangement shown in FIGS. 4 and 5 is, however, that in the case of stress, the fin blades 12 and 12*a* are of a design such that without the bending prevention arrangement 125 they would tend to bend or bulge outwardly. The reason for this is that the flexible elements or wires 125 act merely as pulling elements which exert a pulling force between the blades 12, 12*a* when they are stressed in the unfolded state of the fin 11. However, such flexible elements 125 cannot act as pushing elements as would be necessary if the fin blades 12 and 12*a* were to bend inwardly as shown in FIG. 3.

Figure 6A:
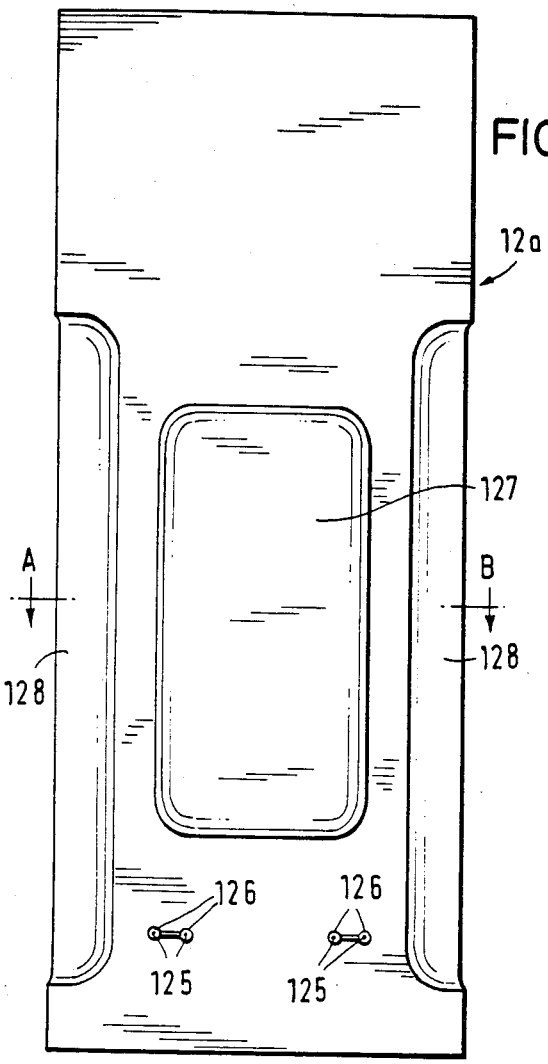
FIG. 6*a* is a side view of a preferred embodiment of a fin according to the invention.
Figure 6B:
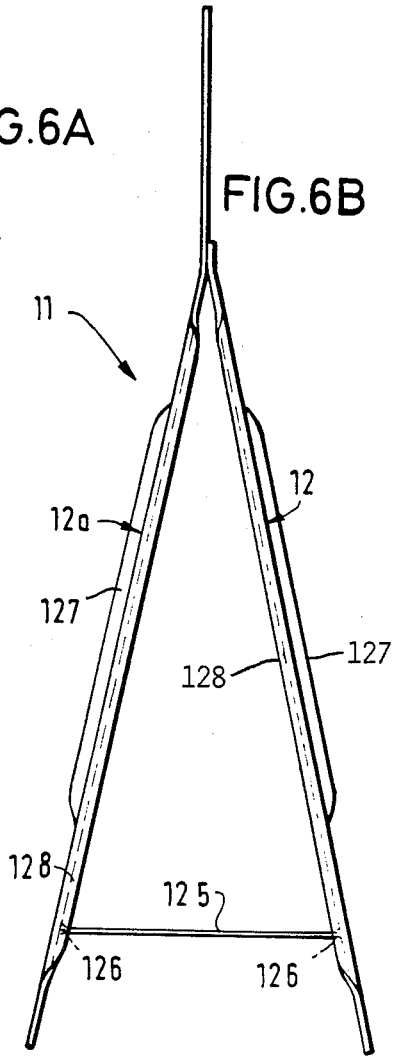
FIG. 6*b* is a front view of the fin of FIG. 6*a* seen in the direction of the longitudinal axis of the projectile.
Figure 6C:
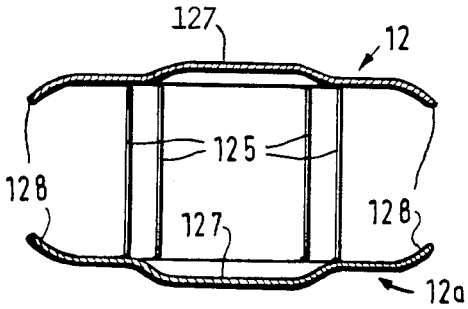
FIG. 6*c* is a cross-sectional view of the fin of FIGS. 6*a* and 6*b* seen along line A–B of FIG. 6*a*.

An example of a fin 11 in which only outward bending can take place for a fin blade without a bending prevention arrangement according to the invention is shown in FIGS. 6*a* to 6*c*.

FIG. 6*a* is a side view of the fin 11 showing the respective fin blade 12*a*, with the other parts of the projectile being omitted for the sake of clarity, while FIG. 6*b* is a view of the fin 11 of FIG. 6*a* in the direction of the projectile axis as seen from the rear section of the projectile. The blade 12*a* is provided with a center dish shaped region 127 which bulges outwardly, and with partial edge regions 128 which are bent slightly inwardly. With these measures it is accomplished that undesirable bending or bulging of the blade 12*a* would occur outwardly if there were no bending prevention arrangement 125 according to the invention, and that the bending stability without the bending prevention arrangement is extremely high, The respective solder locations for the wires 125 are again marked with the numeral 126. In the illustrated embodiment, the bending prevention arrangement is composed of four parallel wires 125.

FIG. 6*c* is a sectional view of the fin seen along line A–B of FIG. 6*a*. Clearly noticeable here are the bulging region 127, the edge regions 128 and the bending prevention arrangement 125 composed of four wires.

The present disclosure relates to the subject matter disclosed in Federal Republic of Germany application No. P 36 18 956.1 filed June 5th, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a guide assembly for projectiles and missiles, said guide assembly including a plurality of fins which are foldable and unfoldable in the circumferential direction, and with each said fin including two fin blades whose tips are connected together and whose roots are fastened to separate bearings which are mounted on said guide assembly and whose circumferential spacing is variable such that, in the unfolded state of said fins, said fin blades are arranged in the manner of a peaked roof when viewed in the direction of the longitudinal axis of the guide assembly, and wherein said bearings are comprised of an articulated fixed bearing and an articulated slide guide bearing; the improvement comprising at least one means provided between said two fin blades of a fin in the vicinity of their root ends for preventing bending of said fin blades under stress when said fin is in the unfolded state.

2. A guide assembly as defined in claim 1, wherein: said fin blades are of the type which would bend outwardly without said bending prevention means; and said bending prevention means comprise pulling means for exerting a pulling force between said fin blades when said fin is stressed in the unfolded state.

3. A guide assembly as defined in claim 2, wherein each said pulling means is a wire connected between said fin blades of a fin.

4. A guide assembly as defined in claim 2 wherein each said pulling means is a strip of sheet metal connected between said fin blades of a fin.

5. A guide assembly as defined in claim 2, wherein each said pulling means is a chain connected between said fin blades of a fin.

6. A guide assembly as defined in claim 2 wherein each of said fin blades is additionally provided with means for preventing inward bending when the associated unfolded fin is stressed.

* * * * *